United States Patent [19]

Jensen et al.

[11] Patent Number: 4,739,821

[45] Date of Patent: Apr. 26, 1988

[54] APPARATUS FOR MAKING MOULD PARTS WITH A HORIZONTAL PARTING FACE

[75] Inventors: Claus T. Jensen, Hedehusene; Joern E. Johansen, Oelstykke; Haakon Kauserud, Ballerup, all of Denmark

[73] Assignee: Dansk Industri Syndikat A/S, Herlev, Denmark

[21] Appl. No.: 108,830

[22] PCT Filed: Feb. 24, 1987

[86] PCT No.: PCT/DK87/00018

§ 371 Date: Oct. 6, 1987

§ 102(e) Date: Oct. 6, 1987

[87] PCT Pub. No.: WO87/05240

PCT Pub. Date: Sep. 11, 1987

[30] Foreign Application Priority Data

Feb. 26, 1986 [DK] Denmark ..... 884/86

[51] Int. Cl.[4] ..... B22C 15/22; B22C 15/28

[52] U.S. Cl. ..... 164/160.1; 164/195

[58] Field of Search ..... 164/160.1, 7.1, 195, 164/38

[56] References Cited

U.S. PATENT DOCUMENTS 4,182,395 1/1980 Bühler ..... 164/160.1 X 4,620,584 11/1986 Witt ..... 164/160.1

*Primary Examiner*—Nicholas P. Godici

*Assistant Examiner*—J. Reed Batten, Jr.

*Attorney, Agent, or Firm*—Larson and Taylor

[57] ABSTRACT

A apparatus for making mould parts with a horizontal parting face consists of a container (1) in which is kept moulding material (2), preferably moulding sand, a moulding chamber (3) which may be subjected to vacuum and which may be defined at the bottom by a pattern plate (4) and at the top by a squeeze plate (5). Moulding material (2) is impulsively sucked into the moulding chamber (3) through the squeeze plate (5) and is post-compacted in it by advancing the squeeze plate (5) with the pattern plate (4), which carries a half pattern. The moulding material (2) is sucked into the moulding chamber (3) through a slot (6) placed centrally in the squeeze plate (5). The container (1) is tapered in V-shape at the bottom (7) in the direction of the slot (6) in its entire longitudinal direction. One or more air intake openings (8) are provided on the tapered side faces of the container (1). The air flow across the oblique container side faces towards the bottom slot (6) reduces the friction between the moulding material and the container in the inlet.

4 Claims, 1 Drawing Sheet

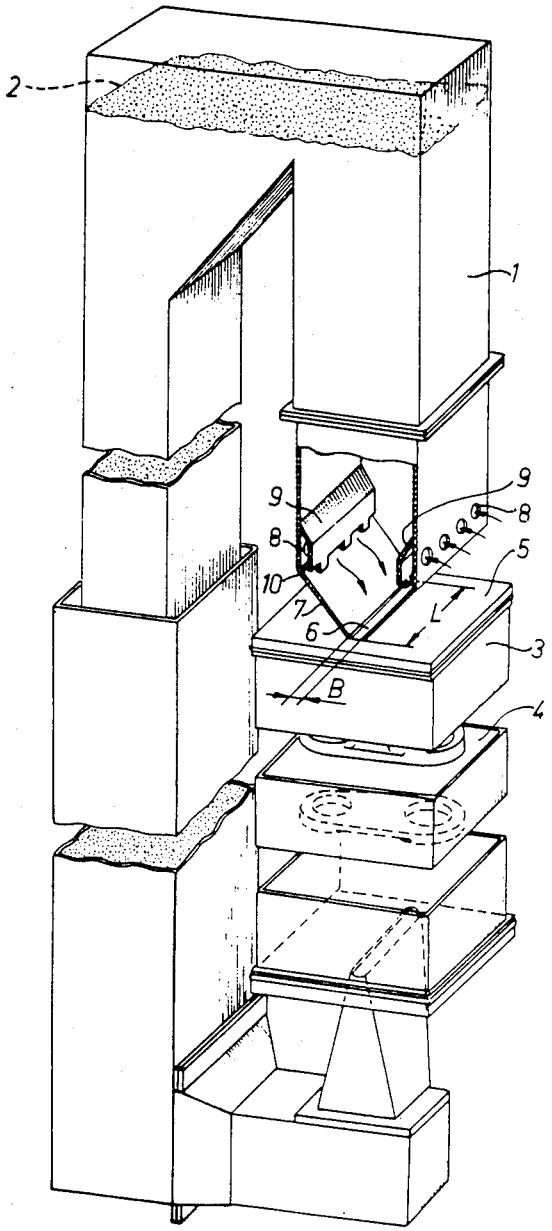
2
1
9
9
8
8
5
10
7
6
L
3
B
4

APPARATUS FOR MAKING MOULD PARTS WITH A HORIZONTAL PARTING FACE

TECHNICAL FIELD

The invention relates to an apparatus for making mould parts with a horizontal parting face and of the type that includes a container for the moulding material, preferably moulding sand, a moulding chamber which may be subjected to vacuum, and which may be defined at the bottom by a pattern plate and at the top by a squeeze plate, whereby the moulding material is impulsively sucked into the moulding chamber through the squeeze plate and is post-compacted in it by advancing the squeeze plate with the pattern plate, which carries a half pattern.

BACKGROUND ART

In this type of apparatus, the moulding sand tends to bridge and clot in the inlet to the moulding chamber due to internal friction in the moulding material and to its friction against the walls of the container.

Attempts have been made to overcome the disadvantages by using a funnel-shaped inlet connecting the container with inlet openings in the squeeze plate above the moulding chamber, and by providing fluidization of the funnel-shaped inlet by applying pressure through nozzle filters in the funnel sides. An apparatus of this type is described in the Danish patent application No. 2945/84.

However, it has been found that the nozzle filters tend to block when using comparatively dry moulding material, and the positive supply of pressurized air is a complex measure making the apparatus more expensive.

SUMMARY OF THE INVENTION

The object of the invention is to provide an apparatus of the type referred to in the opening paragraph, where the danger of blocking and bridging in the inlet to the moulding chamber has been eliminated, at the same time as satisfactory filling and compaction of the moulding material are achieved in the moulding chamber.

According to the invention, this object is achieved by an apparatus of the type described in the opening paragraph characterized in that the moulding material is sucked into the moulding chamber through a slot placed centrally in the squeeze plate, and that the bottom of the container is tapered in V-shape in the direction of the slot in its entire longitudinal direction, whereby one or more air intake openings are provided on the tapered side faces of the container.

It has been found that the amount of air sucked in due to the vacuum in the moulding chamber generates an air cushion, which reduces friction in the inlet and "rinses" the oblique, tapered sides of the container. Providing one slot ensures maximum moulding material flow by time unit, as the moulding material will flow laminarly through the slot in the same way as in the case of unobstructed emptying from a bag-shaped orifice.

According to the invention, the slot may have a length and a width corresponding to the moulding chamber, ranging from 30 to 90 mm, preferably 55 mm.

Experiments have shown that particularly excellent filling is obtained when slot widths are kept within this interval, and a slot width of 55 mm is particularly advantageous.

In a perferred embodiment of an apparatus according to the invention, screen plates are placed above the air intake openings on the side faces placed opposite each other in the container bottom tapered in V-shape, while forming side slots some distance above the bottom slot.

By placing screen plates, the danger of blocking the intake openings is eliminated, and a slot is formed, so that the sucked-in air can be directionally led across the oblique container side faces, preferably towards the slot in the bottom of the container. The friction-reducing rinsing effect is increased by this measure.

BRIEF DESCRIPTION OF THE DRAWING

The invention will be described in more detail below with reference to the drawing, whole single FIGURE gives an oblique schematic view of an apparatus designed according to the invention.

DESCRIPTION OF THE PREFERRED EMBODIMENT

The apparatus includes a container 1 for keeping the moulding material 2, preferably moulding sand.

In the embodiment shown in the drawing, the apparatus is used for simultaneous making of two matching mould parts in an upper and a lower moulding chamber, the bottom moulding chamber connecting with the container 1 via an L-shaped down pipe. The lower moulding chamber and the L-shaped down pipe are however not a prerequisite for the invention and will consequently not be described in more detail.

Below the container 1 there is a moulding chamber 3, at its top defined by a squeeze plate 5 and at the bottom designed for closing against a pattern plate 4, which, as indicated, may be removed from the area below the moulding chamber for pattern plate replacement.

The container 1 connects with the moulding chamber 3 through an inlet tapered in V-shape at the bottom 7 of the container. The tapered inlet merges into a slot 6 in the squeeze plate 5. The slot has a length L, equal to the length of the moulding chamber, and a width B, preferably in the range from 30 to 90 mm.

In the side faces of the container tapered in V-shape there are air intake openings 8, in the shown embodiment covered by a screen plate 9 internally in the container. Between the screen plate 9 and the container wall, there are air slots 10, from which the air is led towards the slot 6 across the bottom side face 7.

In the embodiment shown in the drawing, four circular openings 8 are provided at each container side. Of course it is within the concept of the invention to provide a different number of holes and differently shaped holes, and it might be advantageous to use one slot instead of several openings. What is decisive is simply to provide a suitable pressure drop across the openings and thus sufficient speed in the air flowing from the side slot 10 to the bottom slot 6.

It is moreover within the concept of the invention to apply a smaller positive pressure to the openings 8, as the intended effect is achieved due to the pressure difference between the area behind the side slots 10 and the moulding chamber 3 under vacuum.

The moulding material is compacted in the moulding chamber by sucking in secondary air from the area above the moulding material in the container, down through the moulding material and out through the openings through which the vacuum is applied. The primary air intake through the openings 8 will speed up compaction, as this primary air flow is added to the secondary air flow.

We claim:

1. An apparatus for making mould parts with a horizontal parting face, including a container (1) for the moulding material (2), preferably moulding sand, a moulding chamber (3), which is connected to a vacuum source and which may be defined at the bottom by a pattern plate (4) and at the top by a squeeze plate (5), whereby the moulding material (2) is impulsively sucked into the moulding chamber (3) through the squeeze plate (5) and is post-compacted in it by advancing the squeeze plate (5) with the pattern plate (4), which carries a half pattern, characterized in that a slot (6) is placed centrally in the squeeze plate (5) through which the moulding material is sucked into the moulding chamber, and that the container (1) is tapered in V-shape at the bottom (7) in the direction of the slot (6) in its entire longitudinal direction, whereby one or more air intake openings (8) are provided on the tapered side faces of the container (1).

2. An apparatus according to claim 1, characterized in that the slot (6) has a length (L) and a width (B) corresponding to the moulding chamber (3) ranging from 30 to 90 mm.

3. An apparatus according to claim 1, characterized in that screen plates (9) are placed above the air intake openings (8) on the side faces placed opposite each other in the V-shaped tapered container bottom (7), while forming side slots (10) placed some distance above the bottom slot (6).

4. An apparatus according to claim 2, wherein the slot (6) has a width (B) of 55 mm.

* * * * *